US011638449B2

(12) United States Patent
Rowe et al.

(10) Patent No.: US 11,638,449 B2
(45) Date of Patent: May 2, 2023

(54) GLOVE AND GARMENT SYSTEM

(71) Applicant: Target Brands, Inc., Minneapolis, MN (US)

(72) Inventors: Catherine R. Rowe, Plymouth, MN (US); Sarah J. Zahradka, St. Paul, MN (US)

(73) Assignee: Target Brands, Inc., Minneapolis, MN (US)

( * ) Notice: Subject to any disclaimer, the term of this patent is extended or adjusted under 35 U.S.C. 154(b) by 16 days.

(21) Appl. No.: 17/230,208

(22) Filed: Apr. 14, 2021

(65) Prior Publication Data

US 2022/0330632 A1 Oct. 20, 2022

(51) Int. Cl.
*A41D 19/00* (2006.01)
*A44B 11/00* (2006.01)

(52) U.S. Cl.
CPC ..... *A41D 19/0041* (2013.01); *A44B 11/005* (2013.01)

(58) Field of Classification Search
CPC ..... A41D 19/0041; A41D 19/0034; A41D 19/0089; A41D 1/02; A44B 11/2561; A44B 11/2553; A44B 11/2511; A44B 11/006; Y10T 24/45241; Y10T 24/3401; A45F 5/02
See application file for complete search history.

(56) References Cited

U.S. PATENT DOCUMENTS 1,361,565 A * 12/1920 Christy ..... A41D 19/0041 2/160
2,136,879 A * 11/1938 Haber ..... A41D 27/10 2/270
2,274,510 A * 2/1942 Wohl ..... A41D 19/0041 D2/614
2,421,848 A * 6/1947 Philipps ..... A41D 19/0041 2/270

(Continued)

FOREIGN PATENT DOCUMENTS

GB 468296 A * 7/1937
JP 2021040870 A * 3/2021

OTHER PUBLICATIONS

Aerobics First, https://aerobicsfirst.com/collections/all-junior-apparel/products/obe-61042-b-m-way-jacket, accessed as early as May 12, 2020.

(Continued)

*Primary Examiner* — Jillian K Pierorazio
(74) *Attorney, Agent, or Firm* — Leanne Taveggia Farrell; Westman, Champlin & Koehler, P.A.

(57) ABSTRACT

A glove and garment system includes a garment having a first sleeve and a second sleeve, a first glove and a second glove. A first female buckle portion is mounted to the first glove, a first male buckle portion is mounted to the first sleeve, a second female buckle portion is mounted to the second sleeve and a second male buckle portion is mounted to the second glove. In a first configuration, the first male buckle portion is buckled to the first female buckle portion (Continued)

to fix the first glove to the first sleeve and the second male buckle portion is buckled to the second female buckle portion to fix the second glove to the second sleeve. In a second configuration, the first female buckle portion is buckled to the second male buckle portion to fix the first glove to the second glove.

20 Claims, 13 Drawing Sheets

(56) References Cited

U.S. PATENT DOCUMENTS 2,558,533 A * 6/1951 Bell ..... A41D 27/10 2/323
2,710,409 A * 6/1955 Burandt ..... A41D 19/0034 2/160
3,214,771 A * 11/1965 Treiber ..... A41D 27/10 2/270
4,297,746 A * 11/1981 Zarbos ..... A41D 19/0041 2/108
4,351,067 A * 9/1982 Bartels ..... A41D 19/0034 224/675
4,359,784 A 11/1982 Harrington
5,177,881 A * 1/1993 Moore ..... A63B 55/408 206/315.3
5,950,240 A * 9/1999 Carpenter ..... A41D 19/0041 2/160
6,212,688 B1 * 4/2001 Leslie ..... A41D 19/0041 2/160
6,487,756 B1 * 12/2002 Vidal, Jr. ..... B25H 3/006 242/379.2
7,571,494 B2 * 8/2009 Grilliot ..... A62B 35/0037 2/69
8,555,416 B1 * 10/2013 Sierra ..... A41D 19/0051 2/167
8,904,564 B2 12/2014 Laycock et al.
D774,725 S 12/2016 Goldman
9,926,054 B2 3/2018 Berry
11,064,747 B2 * 7/2021 Zahradka ..... A41D 27/10
2001/0025384 A1 * 10/2001 Kester ..... A45F 4/14 2/93
2005/0223471 A1 10/2005 Griesbach, III et al.
2006/0196896 A1 * 9/2006 Pecor ..... A45F 5/02 223/1
2007/0095870 A1 * 5/2007 Griffith ..... A45C 13/30 24/3.2
2009/0064400 A1 * 3/2009 Garrigos ..... A41D 13/0002 2/323
2010/0064485 A1 * 3/2010 Blevins ..... A63B 55/408 24/317
2010/0095426 A1 * 4/2010 Esten ..... A41D 19/01594 2/163
2012/0017347 A1 * 1/2012 Strum ..... A41D 13/0007 24/3.1
2012/0060256 A1 * 3/2012 Parker ..... A41D 19/0041 2/85
2012/0186047 A1 * 7/2012 Carnate ..... A45F 5/06 24/305
2012/0204318 A1 * 8/2012 Dark ..... A41D 19/0041 2/160
2013/0302558 A1 * 11/2013 Schoenbeck ..... A41D 19/0034 2/239
2014/0173804 A1 * 6/2014 Matos ..... A45F 5/06 24/3.12
2014/0220291 A1 * 8/2014 Schoenbeck ..... A41B 11/002 2/160
2015/0135492 A1 * 5/2015 Chiang ..... A44B 11/2588 24/598.1
2015/0189931 A1 * 7/2015 Elliott ..... A41D 19/0041 24/3.12
2015/0351475 A1 * 12/2015 Reed ..... A44B 13/00 2/159
2016/0007722 A1 * 1/2016 Macon ..... A45F 5/06 2/93
2016/0128400 A1 * 5/2016 Cookus ..... A41D 19/0089 2/164
2018/0042317 A1 * 2/2018 Cornelius ..... A45F 5/02
2018/0064190 A1 * 3/2018 Khan ..... A42B 1/048
2018/0255848 A1 * 9/2018 Moreau ..... A41D 19/0024
2018/0344014 A1 * 12/2018 Grant ..... A45C 13/1092
2019/0000165 A1 * 1/2019 Reed ..... A41F 1/06
2019/0307186 A1 * 10/2019 Abed Ruiz ..... A41D 27/10
2019/0380453 A1 * 12/2019 Hortnagl ..... A44B 11/2584
2021/0289862 A1 * 9/2021 Jones ..... A41D 19/0041
2022/0218057 A1 * 7/2022 Carel ..... A41D 13/02

OTHER PUBLICATIONS

Legowear Tec Mittens, https://www.legowear.com/lego-wear-shop/accessories/gloves-mittens/detail/lwaustin-701-496, accessed as early as May 12, 2020.
Legowear Snowsuit, https://www.legowear.com/lego-wear-shop/outerwear/skiwear/detail/lwjosefine-717-496, accessed as early as May 12, 2020.

* cited by examiner

GLOVE AND GARMENT SYSTEM

BACKGROUND

When weather turns cool or inclement, wearing gloves or mittens with outerwear garments, such as jackets or coats, is essential. Because gloves or mittens are separate from the outerwear garments, oftentimes gloves or mittens are misplaced or lost when taken off, especially for young children in daycare, pre-school and school settings.

The discussion above is merely provided for general background information and is not intended to be used as an aid in determining the scope of the claimed subject matter.

SUMMARY

A glove and garment system including a garment adapted to be worn on a body of a wearer including a first sleeve adapted to be worn on a first arm of the wearer and a second sleeve adapted to be worn on a second arm of the wearer. The first sleeve has a first male buckle portion mounted thereon and the second sleeve has a second female buckle portion mounted thereon. The glove and garment system also includes a first glove adapted to be worn on the wearer's first hand and having a first female buckle portion mounted thereon and a second glove adapted to be worn on the wearer's second hand and having a second male buckle portion is mounted thereon. In a first configuration of the glove and garment system, the first male buckle portion is secured to the first female buckle portion to fix the first glove adjacent to a distal end of the first sleeve and the second male buckle portion is secured to the second female buckle portion to fix the second glove adjacent to a distal end of the second sleeve. In a second configuration of the glove and garment system, the first female buckle portion is unbuckled from the first male buckle portion to separate the first glove from the distal end of the first sleeve, the second female buckle portion is unbuckled from the second male buckle portion to separate the second glove from the distal end of the second sleeve and the first female buckle portion is secured to the second male buckle portion to buckle the first glove to the second glove.

A glove and garment system includes a garment adapted to be worn on a body of a wearer and having a first sleeve adapted to be worn on a first arm of the wearer and a second sleeve adapted to be worn on a second arm of the wearer, a use configuration and a storage configuration. The use configuration includes a first female buckle portion mounted to a first glove adapted to worn on a first hand of the wearer and being secured to a first male buckle portion mounted to the first sleeve so that the first glove is fixed adjacent to a distal end of the first sleeve. The use configuration also includes a second male buckle portion mounted to a second glove adapted to be worn on a second hand of the wearer and being secured to a second female buckle portion mounted to the second sleeve so that the second glove is fixed adjacent to a distal end of the second sleeve. The storage configuration includes the first female buckle portion being separated from the first male buckle portion, the second male buckle portion being separated from the second female buckle portion and the first female buckle portion being buckled to the second male buckle portion to fix the first glove to the second glove.

A method is provided and includes placing a glove and garment system into a use configuration and placing the glove and garment system into a storage configuration. In the use configuration, a first female buckle portion mounted to a first glove is buckled to a first male buckle portion mounted to a first sleeve of a garment to fix the first glove adjacent to the first sleeve. Also in the use configuration, a second male buckle portion mounted to a second glove is buckled to a second female buckle portion mounted to a second sleeve of the garment to fix the second glove adjacent to the second sleeve. In the storage configuration of the glove and garment system the first female buckle portion mounted to the first glove is buckled to the second male buckle portion mounted to the second glove so that the first glove and the second glove are fixed together.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

To prevent a wearer's gloves from being lost or misplaced, a glove and garment system is configurable into two different configurations. In a first or use configuration, the gloves are buckled to sleeves of a garment so the gloves cannot be individually lost from the garment and in such a way that the wearer may wear them while buckled or not wear them while buckled. In the second or storage configuration, the gloves are detached or unbuckled from the garment and are buckled to each other so that the gloves cannot be individually lost from each other. These alternative configurations are made possible by one of the gloves having a male or female buckle portion and the other of the gloves having the other of a male or female buckle portion. In addition, one of the two sleeves has a male or female buckle portion and the other of the two sleeves has the other of the male or female buckle portion. In this way each glove is capable of mating to one of the sleeves in the first or use configuration, while also being capable of mating to each other in the second or stored configuration.

Figure 1:
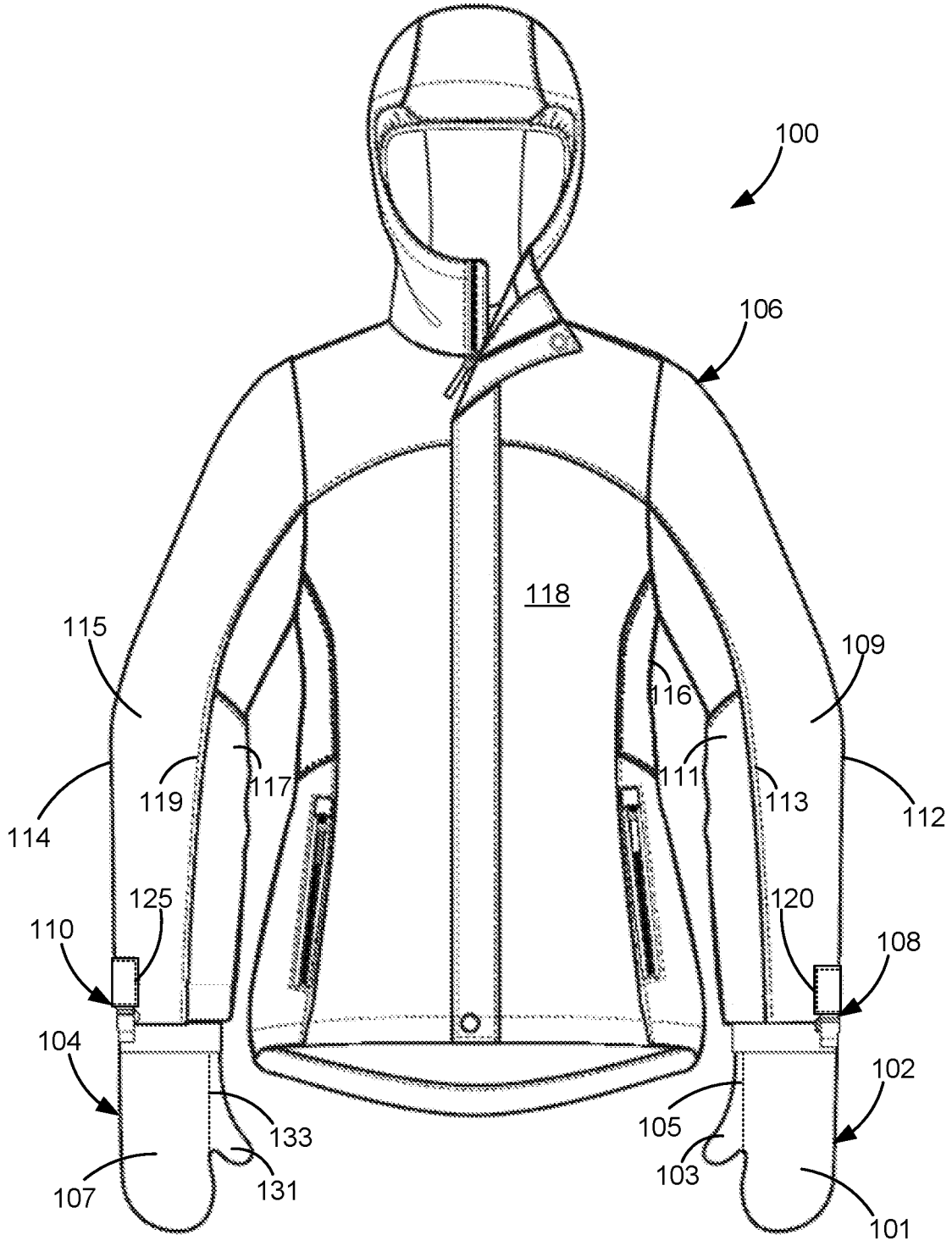
FIG. 1 illustrates a front view of a glove and garment system according to an embodiment, the glove and garment system of FIG. 1 being in a first or use configuration with gloves buckled to the garment, fixed adjacent to sleeves of the garment and being worn on a wearer's hands.
Figure 2:
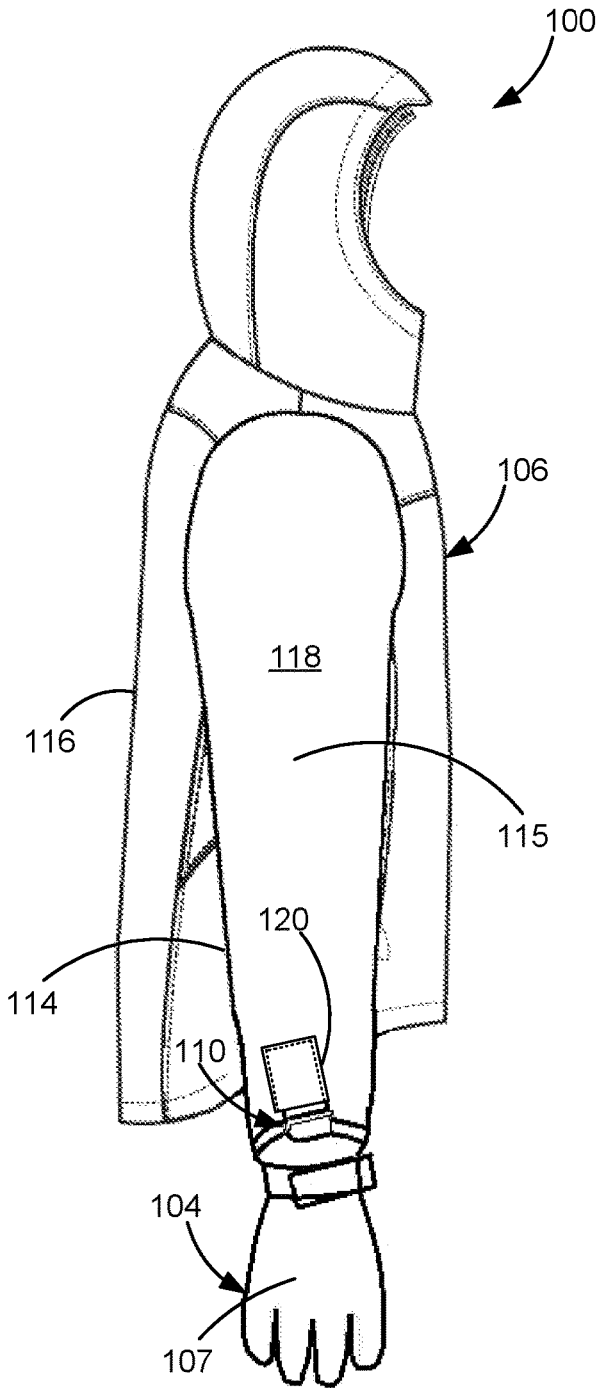
FIG. 2 illustrates a right side view of the glove and garment system of FIG. 1.
Figure 3:
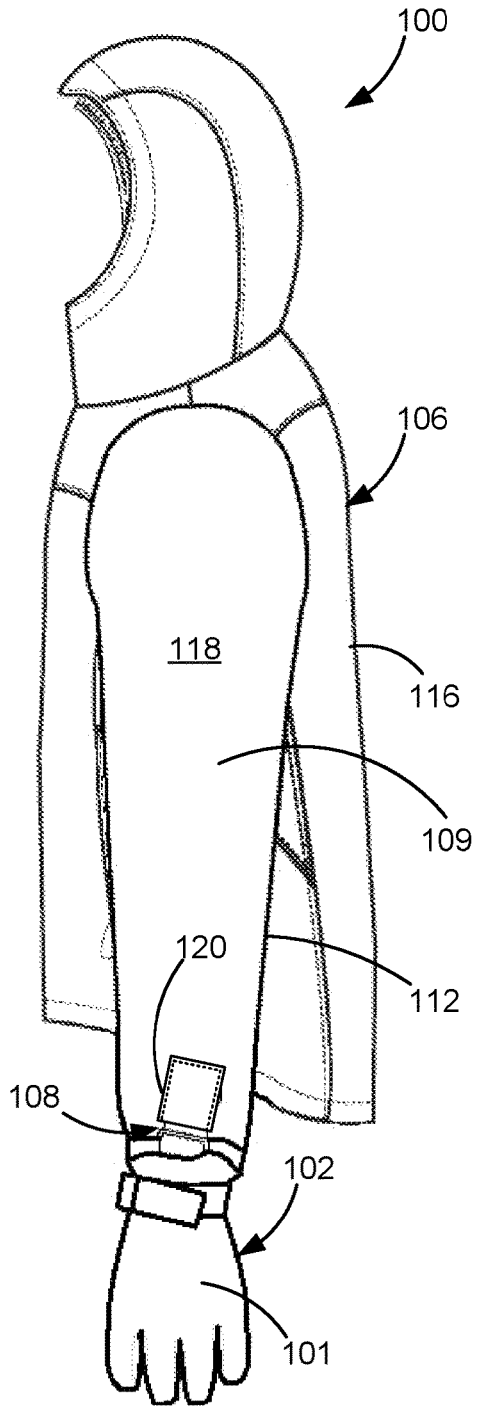
FIG. 3 illustrates a left side view of the glove and garment system of FIG. 1.
Figure 4:
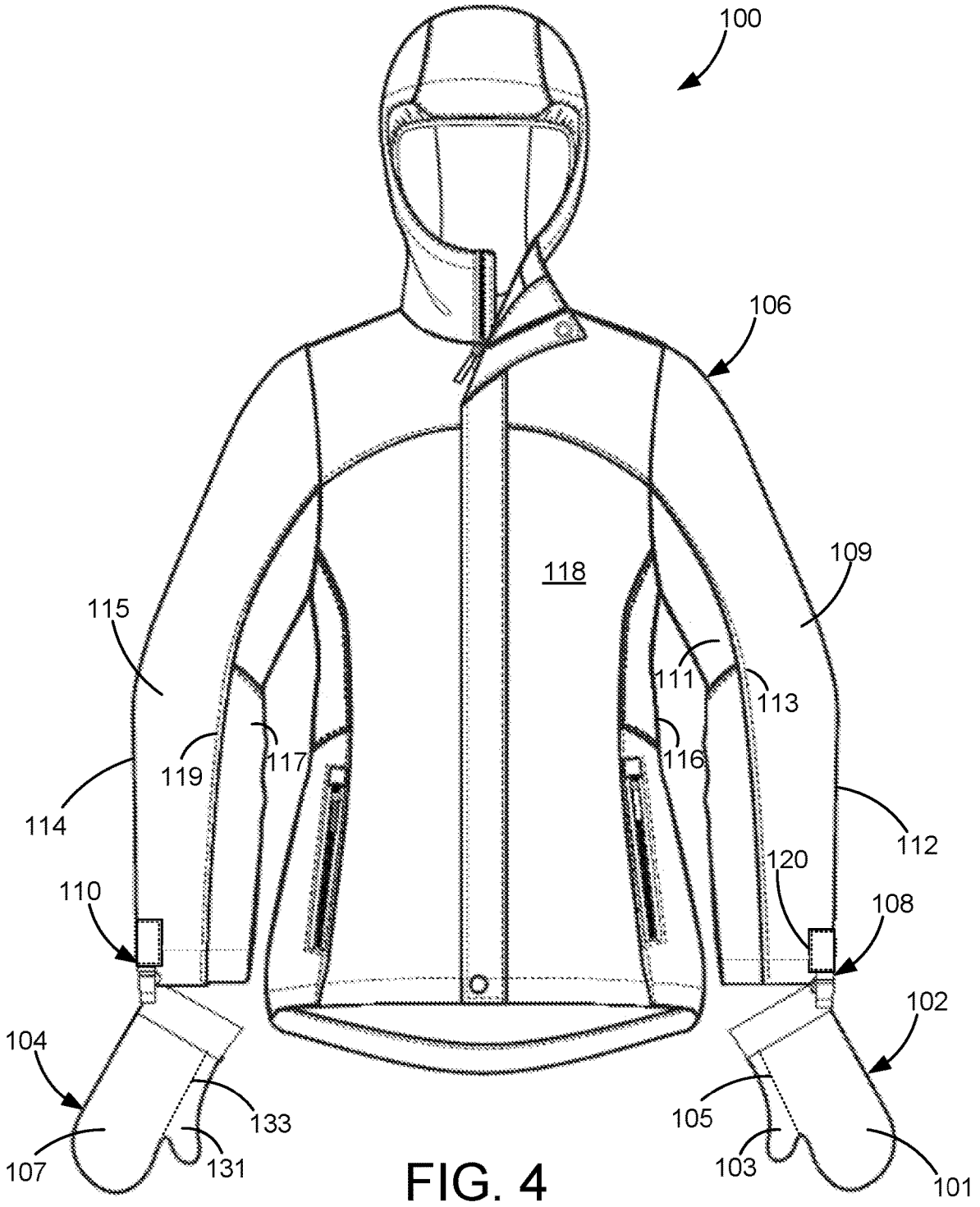
FIG. 4 illustrates a front view of the glove and garment system according to an embodiment, the glove and garment system of FIG. 4 being in first or use configuration with gloves buckled to the garment as in FIG. 1 and fixed adjacent to sleeve of the garment, but not being worn by a wearer's hands.
Figure 5:
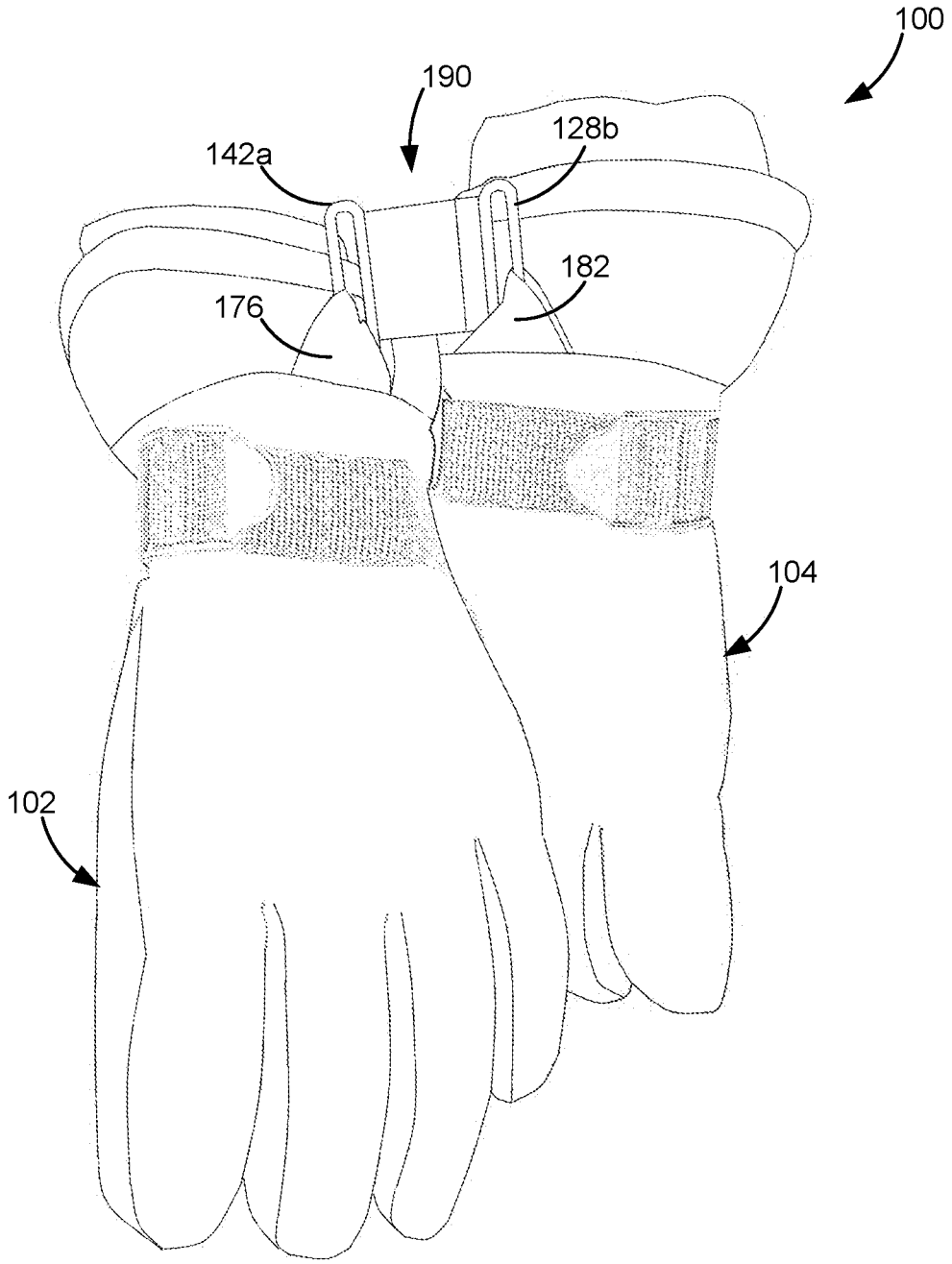
FIG. 5 illustrates a perspective view of the glove and garment system according an embodiment, the glove and garment system being in a second or storage configuration with the pair of gloves buckled together using the portions of the buckles for buckling the gloves to the garment.

FIG. 1 illustrates a front view of a glove and garment system 100 according to an embodiment. As illustrated in FIG. 1, glove and garment system 100 is in a first or use configuration with gloves 102 and 104 being buckled to a garment 106, fixed adjacent to sleeves 112 and 114 of garment 106 and being worn on a wearer's hands. FIG. 2 is a right side view of FIG. 1, but with a different embodiment of glove, and FIG. 3 is a left side view of FIG. 1 and with the different embodiment of glove illustrated in FIG. 2. FIG. 4 is a front view of glove and garment system 100 in the first or use configuration illustrated in FIGS. 1-3 with gloves 102 and 104 buckled to garment 106, but not being worn by a wearer's hands. FIG. 5 illustrates a second or storage configuration of glove and garment system 100 with the pair of gloves 102 and 104 unbuckled or detached from garment 106 and buckled to each other using the female and male portions of the buckles for buckling the gloves to garment 106.

In the first or use configuration, glove and garment system 100 includes at least one glove, for example, a pair of gloves or hand coverings 102 and 104, a garment 106 and a pair of buckles 108 and 110. While buckles 108 and 110 are illustrated as being quick release buckles having center release buttons, buckles 108 and 110 may be other types of quick release buckles including squeeze release buckles. Garment 106 includes a first sleeve 112 and a second sleeve 114 each attached to a torso portion 116 of garment 106. Each of gloves 102 and 104 cover the entirety of a wearer's hand or fist and may have separate sheaths for each finger as illustrated in FIGS. 2, 3 and 5. However, gloves 102 and 104 may not have separate sheaths for all fingers and in that embodiment are called mittens as illustrated in FIGS. 1 and 4. As illustrated in FIGS. 1-4, first glove 102 is adapted to be worn on a wearer's first hand and adjacent to first sleeve 112 of garment 106, while second glove 104 is adapted to be worn on a wearer's second hand and adjacent to second sleeve 114 of garment 106.

As described in detail below, glove and garment system 100 include sleeves 112 and 114 and gloves 102 and 104 and those portions are described in relation to the area to which the sleeves or the gloves cover a wearer. For example, a sleeve of a garment covers at least a wearer's arm and an arm includes a dorsal or posterior side and an opposing ventral or anterior side. Therefore, first sleeve 112 of garment 106 includes a dorsal or posterior side 109 and a ventral or anterior side 111. Dorsal side 109 is coupled to ventral side 111 by a seam 113 (FIGS. 1 and 4). Likewise, second sleeve 114 includes a dorsal or posterior side 115 and a ventral or anterior side 117. Dorsal side 115 is coupled to ventral side 117 by a seam 119 (FIGS. 1 and 4). FIG. 2 is not only a right side view of FIG. 1, but is a view that illustrates dorsal side 115 of sleeve 114. FIG. 3 is not only a left side view of FIG. 1, but is a view that illustrates dorsal side 109 of sleeve 114.

In another example, a glove covers at least a wearer's hand and a hand includes a dorsal or posterior side and an opposing palmer or anterior side. Therefore, first glove 102 includes a dorsal or posterior side 101 and a palmer or anterior side 103. Dorsal side 101 is coupled to palmer side 103 by a seam 105 (FIGS. 1 and 4). Second glove 104 includes a dorsal or posterior side 107 and a palmer or anterior side 131. Dorsal side 107 is coupled to palmer side 131 by a seam 133 (FIGS. 1 and 4). FIG. 2 is not only a right side view of FIG. 1 and a view that illustrates dorsal side 115 of sleeve 114, but FIG. 2 also is a view that illustrates dorsal side 107 of glove 104. FIG. 3 is not only a left side view of FIG. 1 and a view that illustrates dorsal side 109 of sleeve 112, but FIG. 3 also is a view that illustrates dorsal side 101 of glove 102.

Figure 6:
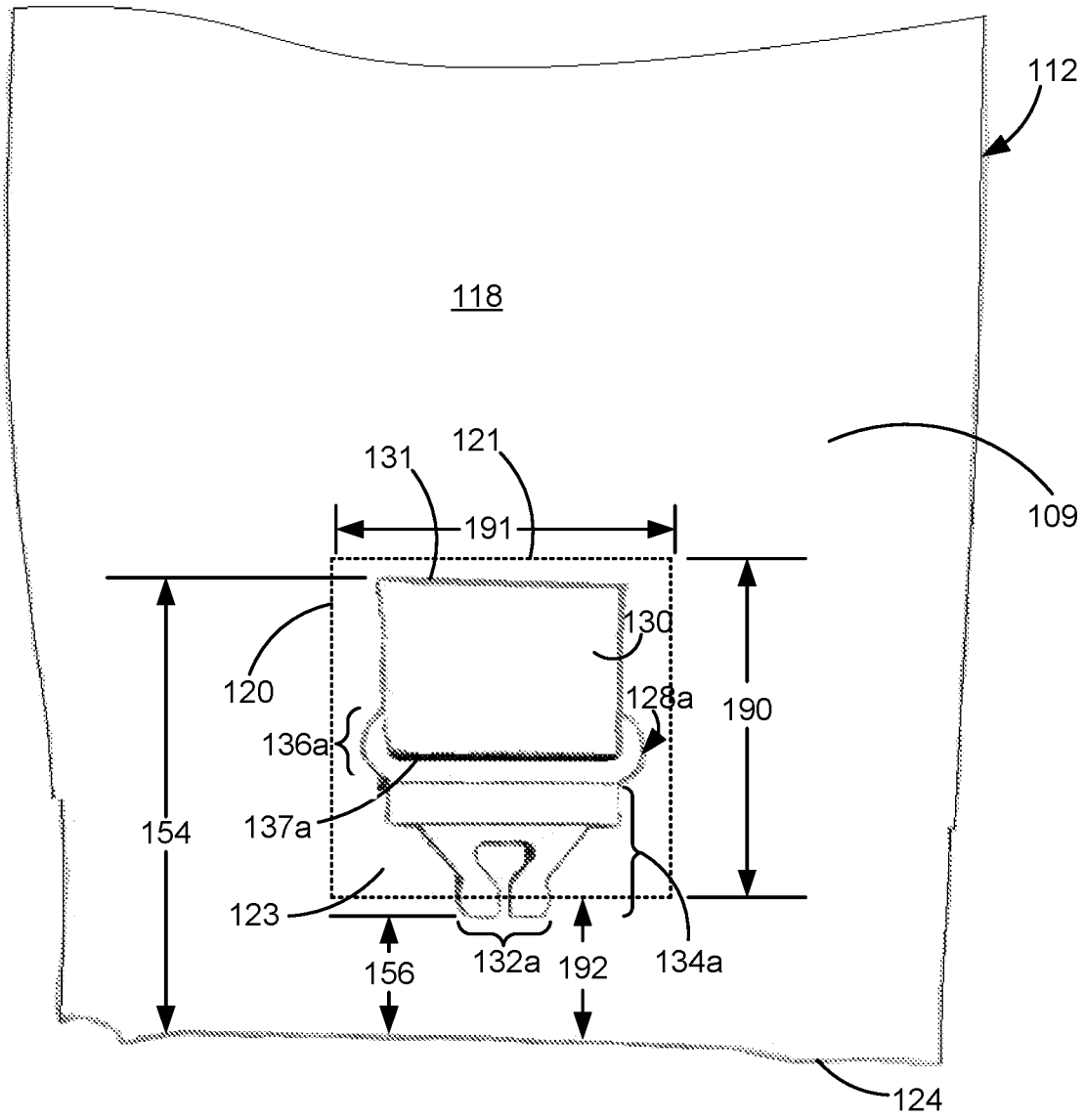
FIG. 6 is an enlarged view of a dorsal end portion of a first sleeve of the garment of the glove and garment system according to an embodiment.
Figure 7:
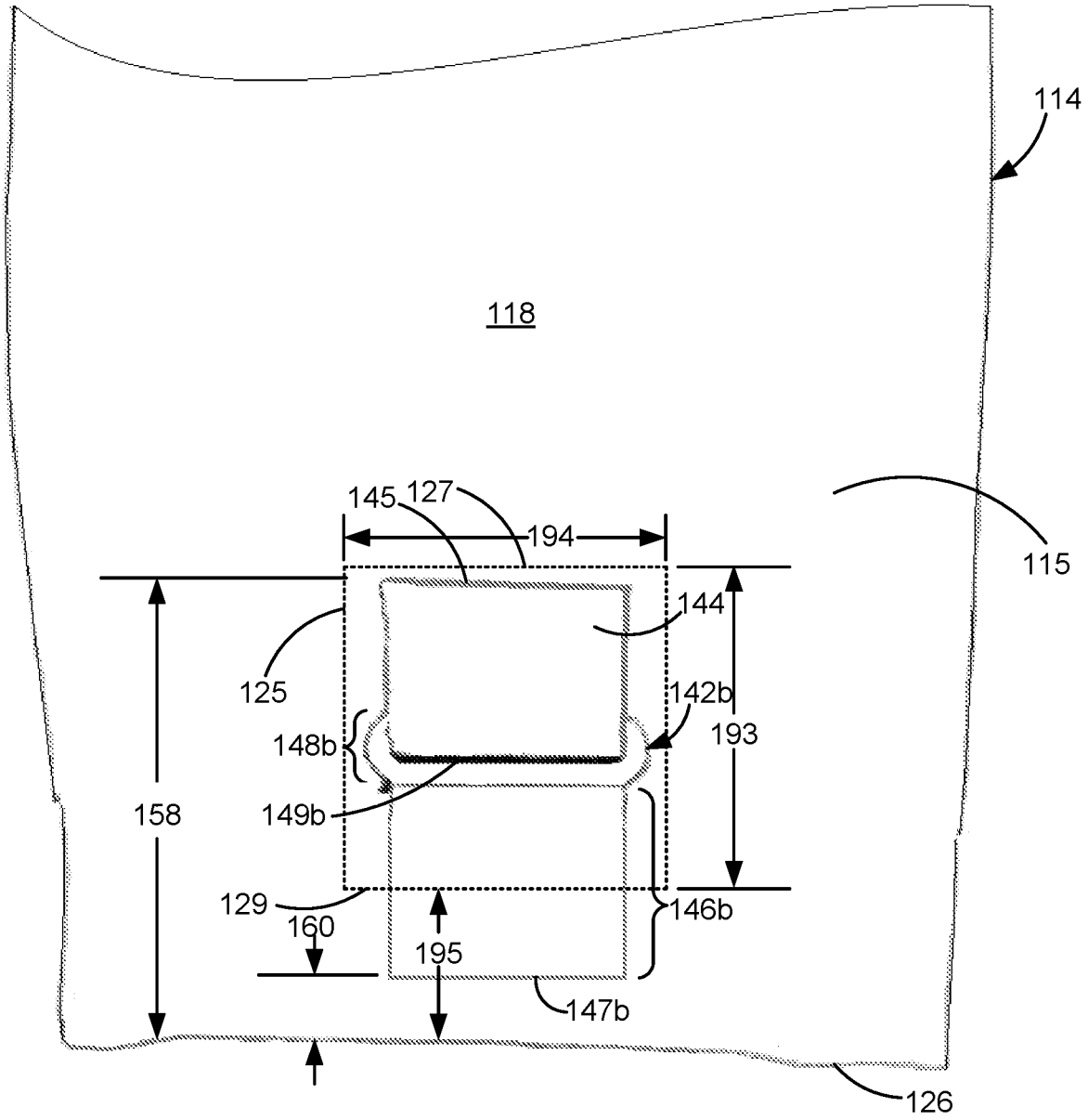
FIG. 7 is an enlarged view of a dorsal end portion of a second sleeve of the garment of the glove and garment system according to an embodiment.

FIG. 6 illustrates an enlarged view of a distal end of dorsal side 109 of first sleeve 112. First sleeve 112 includes a distal edge 124. FIG. 7 illustrates an enlarged view of a distal end of dorsal side 115 of second sleeve 114. Second sleeve 114 includes a distal edge 126. Distal edges 124 and 126 of sleeves 112 and 114 are positioned generally where a wearer's wrist ends and the hand begins.

With reference to FIGS. 1-4 and FIGS. 6 and 7, first sleeve 112, second sleeve 114 and torso 116 all have an exterior surface 118. On exterior surface 118 of dorsal side 109 of first sleeve 112 is mounted a buckle portion **128*a* of first buckle 108. Buckle portion 128*a* is a male portion of first buckle 108. In the illustrated embodiment in FIG. 6, male buckle portion 128*a* is mounted to exterior surface 118 of dorsal side 109 of first sleeve 112 with a first fabric loop 130. In particular, male buckle portion 128*a* is mounted to a central location of dorsal side 109 of first sleeve 112 proximal to distal edge 124**.

On the exterior surface 118 of dorsal side 115 of second sleeve 114 is mounted a buckle portion **142*b* of second buckle 110. Buckle portion 142*b* is a female portion of second buckle 110. In the illustrated embodiment in FIG. 7, female buckle portion 142*b* is mounted to exterior surface 118 of dorsal side 115 of second sleeve 114 with a second fabric loop 144. In particular, female buckle portion 142*b* is mounted to a central location of dorsal side 115 of second sleeve 114 proximal to distal edge 126**.

Figure 9:
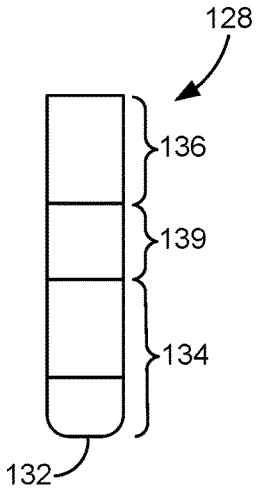
FIG. 9 is a side view of FIG. 8.
Figure 8:
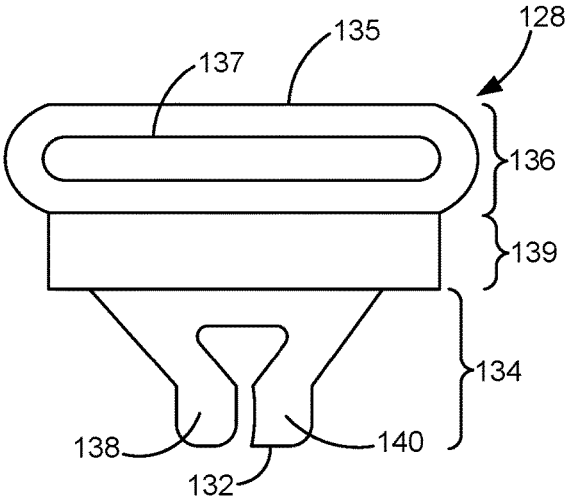
FIG. 8 is a front view of a male buckle portion of the glove and garment system according to an embodiment.
Figure 10:
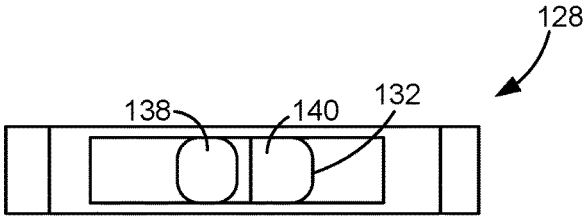
FIG. 10 is a bottom view of FIG. 8.
Figure 11:
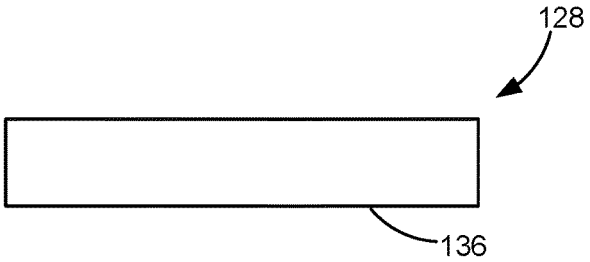
FIG. 11 is a top view of FIG. 8.

FIGS. 8-11 illustrate elevational views of an exemplary male buckle portion 128 that may be used for the buckles described including a FIG. 8 front view, the back view being a mirror image, a FIG. 9 side view, a FIG. 10 top view and a FIG. 11 bottom view. Male buckle portion 128 includes an attachment bar 136 having an attachment bar proximal end 135, a central body 139 and a fastening body 134 with a fastening distal end 132 that opposes attachment bar proximal end 135. Fastening body 134 includes a pair of prongs 138 and 140 having a space therebetween for receiving a center release button on a corresponding female buckle portion. Attachment bar 136 includes a through slot 137. In addition to male buckle portion 128 being male buckle portion 128*a* of a portion of first buckle 108, male buckle portion 128 may be a male buckle portion 128*b* (FIG. 18) of second buckle 110, which will be discussed in detail below.

Figure 12:
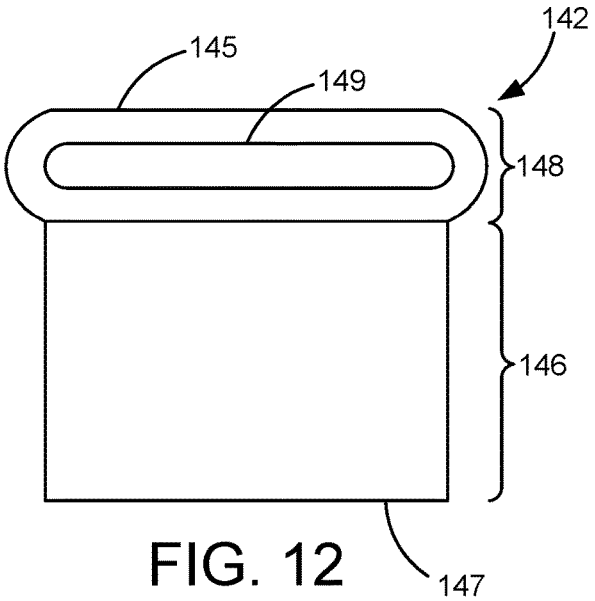
FIG. 12 is a front view of a female portion of the glove and garment system according to an embodiment.
Figure 13:
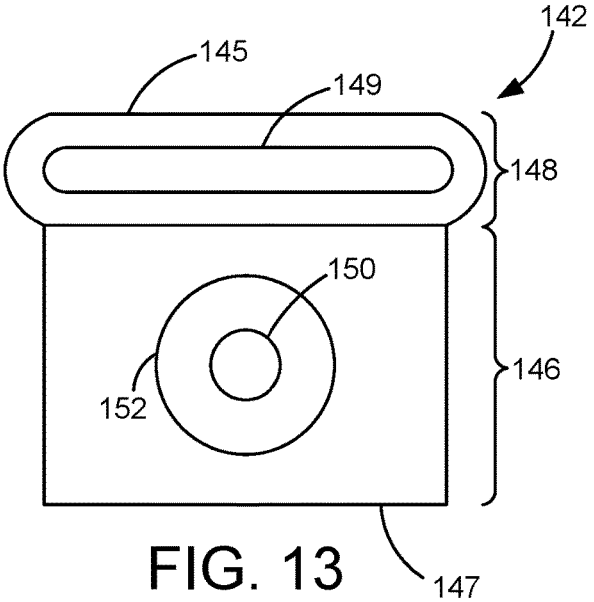
FIG. 13 is a back view of FIG. 12.
Figure 14:
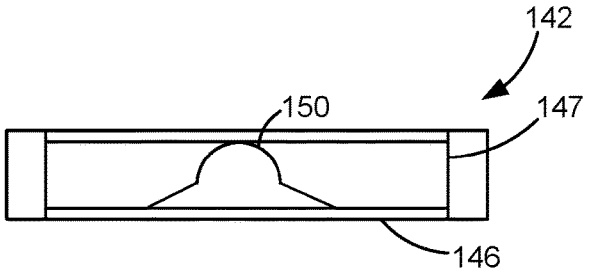
FIG. 14 is a bottom view of FIG. 12.
Figure 15:
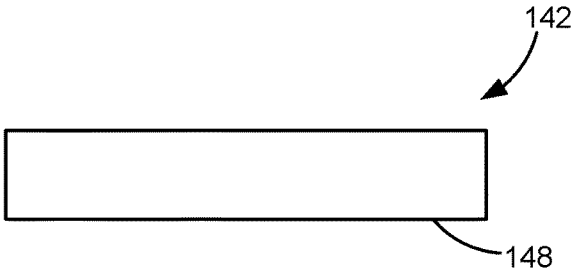
FIG. 15 is a top view of FIG. 12.
Figure 16:
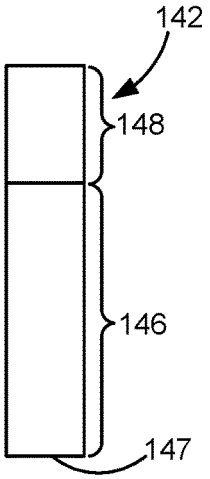
FIG. 16 is a side view of FIG. 12.

FIGS. 12-16 illustrate elevational views of an exemplary female buckle portion 142 that may be used for the buckles described including a FIG. 12 front view, a FIG. 13 back view, a FIG. 14 bottom view, a FIG. 15 top view and a FIG. 16 side view. Female buckle portion 142 includes an attachment bar 148 having an attachment bar proximal end 145 and a fastening body 146. Fastening body 146 has a hollow interior with a distal open end 147 configured to receive fastening body 134 of male buckle portion 128. Inside the hollow interior is a center release button 150 that is accessible through a central aperture 152 illustrated in FIG. 13. Attachment bar 148 includes a through slot 149. In addition, to female buckle portion 142 being female buckle portion 142*b* of a portion of second buckle 110, female buckle portion 142 may be a female buckle portion 142*a* (FIG. 19) of first buckle 108, which will be discussed in detail below.

With reference back to FIG. 6, first fabric loop 130 is threaded through slot 137*a* in attachment bar 136*a* of male buckle portion 128*a* and ends of first fabric loop 130 are stitched to first sleeve 112 at seam 131 so that first fabric loop 130 and therefore fastening body 134*a* of male buckle portion 128*a* extend from exterior surface 118 of dorsal side 109 of first sleeve 112. In particular, the mounting of male buckle portion 128*a* to first sleeve 112 in this manner orients fastening distal end 132*a* to point towards distal edge 124 of first sleeve 112. As indicated in FIG. 6, the ends of first fabric loop 130 are stitched to first sleeve 112 a distance 154 from distal edge 124 of first sleeve 112. Distance 154 is great enough so that fastening distal end 132*a* are spaced apart a distance 156 from distal edge 124 of first sleeve 112. In one embodiment, distance 156 is less than an inch. More specifically, in one embodiment, distance 156 is about 0.5 inches.

As illustrated in FIGS. 1, 3, 4 and 6, a first pocket 120 is mounted on exterior surface 118 of first sleeve 112 that comprises a patch of material that matches the material of first sleeve 112. First pocket 120 is stitched to exterior surface 118 of first sleeve 112 and positioned so as to cover most of male buckle portion 128*a*. In FIG. 6, first pocket 120 is illustrated in phantom so that its positioning relative to male buckle portion 128*a* is clearly illustrated. First pocket 120 includes an enclosed proximal end 121 and an open distal end 123. In one embodiment, first pocket 120 includes a height 190 that is approximately 1.75 inches and a width 191 that is approximately 1.75 inches. First pocket 120 is wide enough to accommodate the width of male buckle portion 128*a* and has a long enough height to accommodate most of the height of male buckle portion 128*a* so as to generally conceal male buckle portion 128*a* when not in use. In one embodiment, open distal end 123 of first pocket 120 is spaced from distal edge 124 of first sleeve 112 a distance 192 that is approximately 0.5 inches.

With reference back to FIG. 7, fabric loop 144 is threaded through slot 149*b* in attachment bar 148*b* of female buckle portion 142*b* and ends of second fabric loop 144 are stitched to exterior surface 118 of second sleeve 114 at seam 145 so that second fabric loop 144 and therefore fastening body 146*b* of female buckle portion 142*b* extend from exterior surface 118 of dorsal side 115 of second sleeve 114. In particular, the mounting of female buckle portion 142*b* to second sleeve 114 in this manner orients open end 147*b* of fastening body 146*b* to point towards distal edge 126 of second sleeve 114. As indicated in FIG. 7, the ends of second fabric loop 144 are stitched to dorsal side 115 of second sleeve 114 a distance 158 from distal edge 126 of cuff 122. Distance 158 is great enough so that open end 147*b* of female buckle portion 142*b* is spaced apart a distance 160 from distal end 126 of cuff 122. In one embodiment, distance 160 is less than an inch. More specifically, in one embodiment, distance 160 is equal to or less than 0.5 inches.

As illustrated in FIGS. 1, 2, 4 and 7, a second pocket 125 is mounted to exterior surface 118 of second sleeve 114 that comprises a patch of material that matches the material of second sleeve 112. Second pocket 125 is stitched to exterior surface 118 of second sleeve 114 and positioned so as to cover a portion of female buckle portion 142*b*. In FIG. 7, second pocket 125 is illustrated in phantom so that its positioning relative to female buckle portion 142*b* is clearly illustrated. Second pocket 125 includes an enclosed proximal end 127 and an open distal end 129. In one embodiment, second pocket 125 includes a height 193 that is approximately 1.75 inches and a width 194 that is approximately 1.75 inches. First pocket 120 is wide enough to accommodate the width of female buckle portion 142*b* and has a long enough height to accommodate most of the height of female buckle portion 142*b* so as to generally conceal female buckle portion 142*b* when not in use. In one embodiment, open distal end 129 of second pocket 125 is spaced from distal edge 126 of second sleeve 114 a distance 195 that is approximately 0.5 inches.

Figure 17:
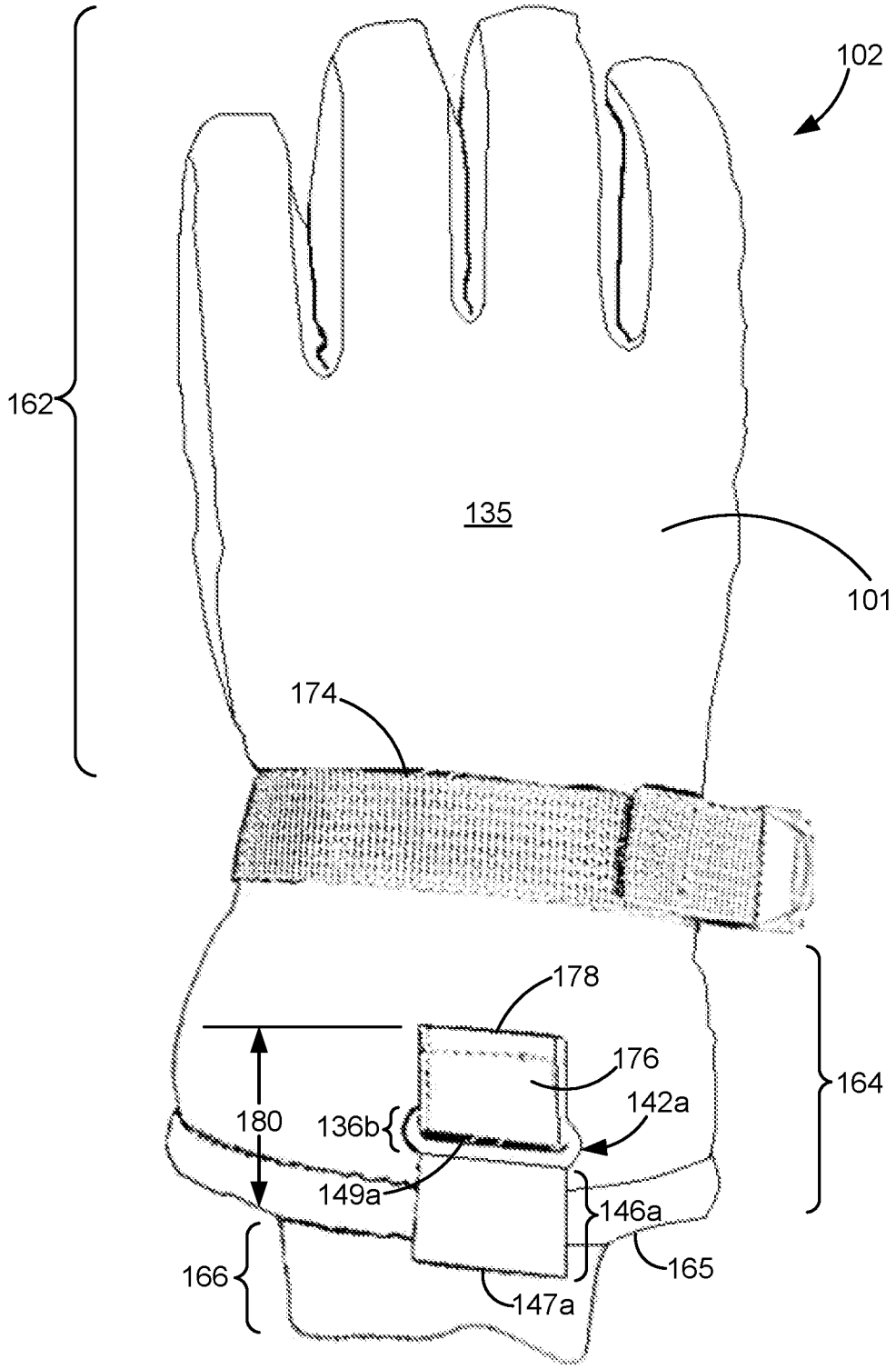
FIG. 17 is a dorsal view of a first glove configured for a wearer's hand of the glove and garment system according to an embodiment.
Figure 18:
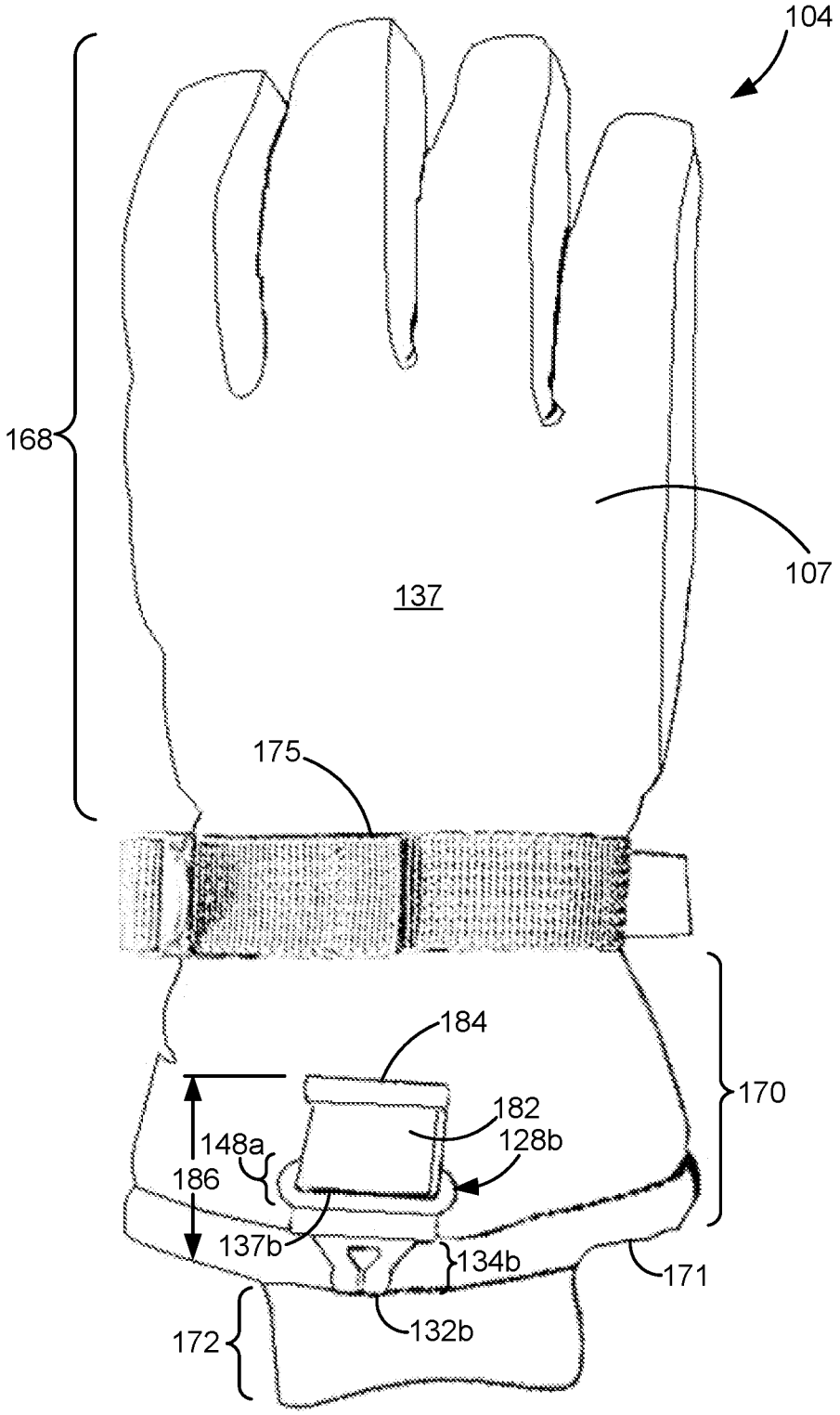
FIG. 18 is a dorsal view of a second glove configured for a wearer's hand of the glove and garment system according to an embodiment.

FIG. 17 illustrates a dorsal view of dorsal side 101 of first glove 102, and FIG. 18 illustrates a dorsal view of dorsal side 107 of second glove 104. First and second gloves 102 and 104 may be left and right gloves made to fit left and right hands of a wearer. First glove 102 includes an exterior surface 135 having a hand section 162, a wrist section 164 including a proximal edge 165 and a cuff section 166. Second glove 104 includes an exterior surface 137 having a hand section 168, a wrist section 170 including a proximal edge 171 and a cuff section 172. In addition, each of first glove 102 and second glove 104 include a strap 174 and 175 for tightening to the wearer's wrists.

While different embodiments of gloves have features that vary as described above, each glove, in general, includes a hand section, whether it includes a thumb sheath and four finger sheathes for receiving each of the four fingers or if it is a mitten where there is a thumb sheath and a single sheath for all four fingers to occupy. Gloves also generally have a wrist section to cover the wearer's wrist. Gloves, however, may or may not have cuffs. In the exemplary embodiment illustrated in FIGS. 17 and 18, cuff sections 166 and 172 include snug fits to cover the wrists and portions of a wearer's forearm. Snug fitting cuffs keep weather and debris out. In some embodiments, gloves do not have cuffs. In other embodiments, gloves may have gauntlet cuffs to provide extra forearm protection.

On the exterior surface 135 of first glove 102 is mounted a female buckle portion 142*a* of a first buckle 108. In the illustrated embodiment, female buckle portion 142*a* is mounted to exterior surface 135 of wrist section 164 of first glove 102 with a third fabric loop 176. Third fabric loop 176 is threaded through slot 149*a* in attachment bar 148*a* of female buckle portion 142*a* and ends of third fabric loop 176 are stitched to first glove 102 at seam 178 so that third fabric loop 176 and therefore female buckle portion 142*a* extend from exterior surface 135 of first glove 102. In particular, the mounting of female buckle portion 142*a* to first glove 102 in this manner orients open end 147*a* of fastening body 146*a* to point towards proximal edge 165 of wrist section 164. As indicated in FIG. 17, the ends of third fabric loop 176 are stitched to exterior surface 135 of wrist section 164 of first glove 102 a distance 180 from proximal edge 165 wrist section 164.

On the exterior surface 137 of second glove 104 is mounted a male buckle portion 128*b* of second buckle 110. In the illustrated embodiment, male buckle portion 128*b* is mounted to exterior surface 137 of wrist section 170 of second glove 104 with a fourth fabric loop 182. Fourth fabric loop 176 is threaded through slot 137*b* in attachment bar 136*b* of male buckle portion 128*b* and ends of fourth fabric loop 182 are stitched to exterior surface 137 of wrist section 170 of second glove 104 at seam 184 so that fourth fabric loop 176 and therefore male buckle portion 128*b* extend from exterior surface 137 of second glove 104. In particular, the mounting of male buckle portion 128*b* to second glove 104 in this manner orients hook end 132*b* of fastening body 134*b* to point towards proximal edge 171 of wrist portion 170 and to cuff section 172. As indicated in FIG. 18, the ends of fourth fabric loop 176 are stitched to exterior surface 137 of wrist section 170 of second glove 104 a distance 186 from proximal edge 171 of wrist section 170.

Figure 19:
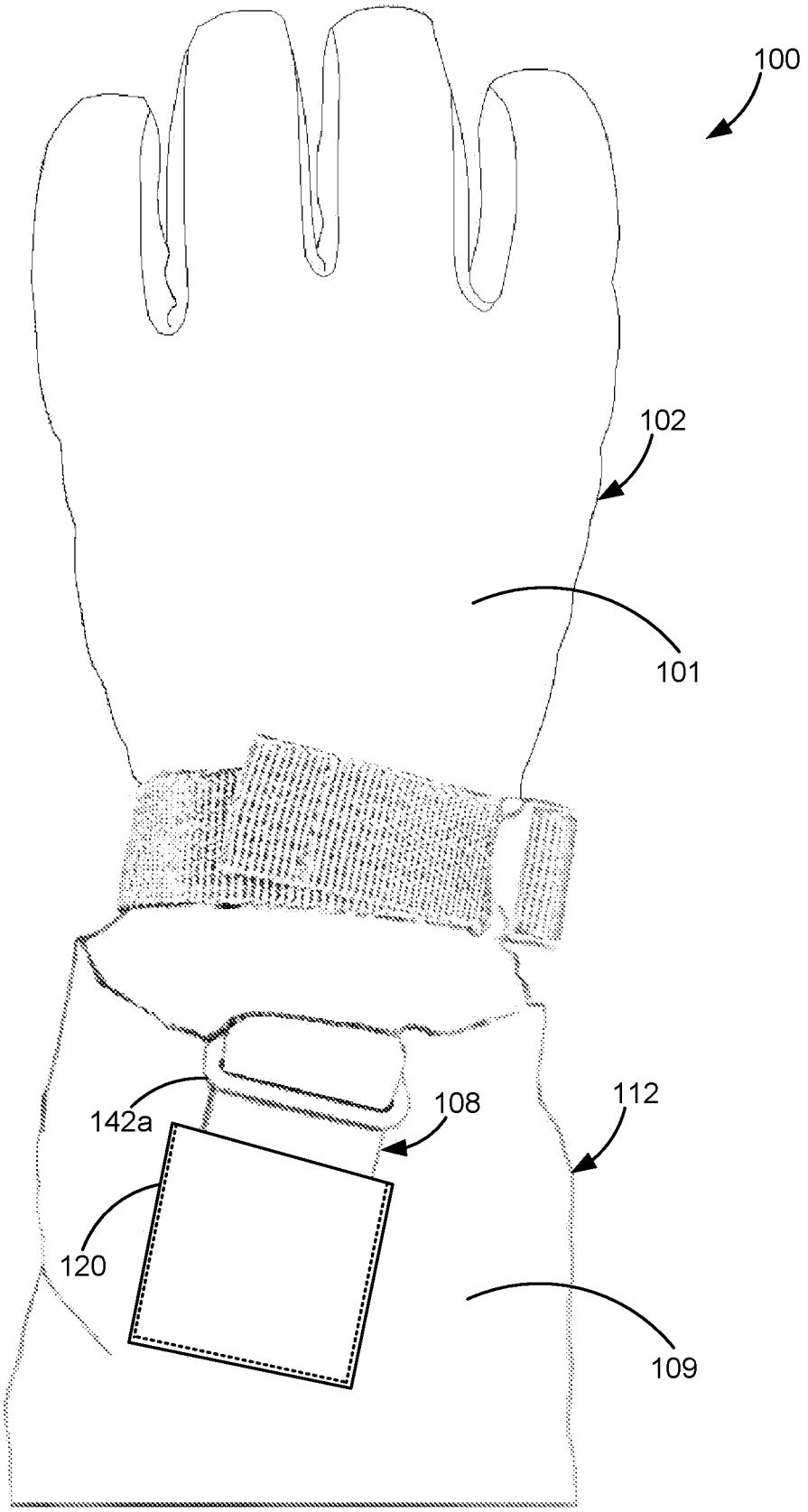
FIG. 19 is a dorsal view of the first glove of FIG. 17 attached to the first sleeve of FIG. 6 of the glove and garment system according to an embodiment.
Figure 20:
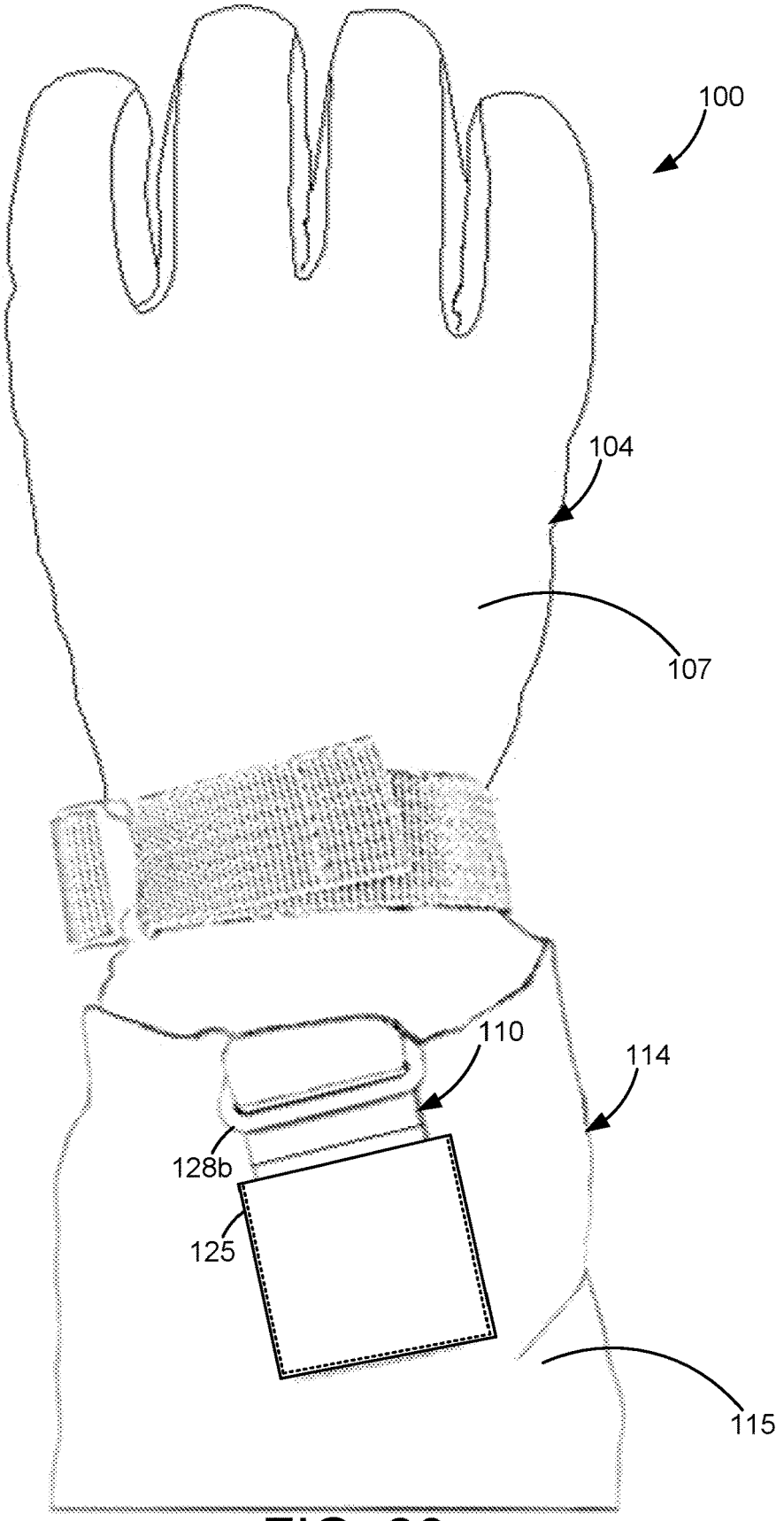
FIG. 20 is a dorsal view of the second glove of FIG. 18 attached to the second sleeve of FIG. 7 of the glove and garment system according to an embodiment.

FIG. 19 illustrates a dorsal view of dorsal side 101 of first glove 102 and dorsal side 109 of first sleeve 112 in the first of use configuration of the glove and garment system 100. FIG. 20 illustrates a dorsal view of dorsal side 107 of second glove 104 and dorsal side 115 of second sleeve 114 also in the first or use configuration of the glove and garment system 100. In FIG. 19, first female buckle portion 142*a* mounted to first glove 102 and first male buckle portion 128*a* mounted to first sleeve 112 (hidden from view) are secured or buckled together to form buckle 108. In this way, whether a wearer's left hand is inside first glove 102 or not, first glove 102 is fixed to first sleeve 112 and will not be lost. In FIG. 20, second male buckle portion 128*b* mounted to second glove 104 and second female buckle portion 142*b* mounted to second sleeve 114 (hidden from view) are secured or buckled together to form buckle 110. In this way, whether a wearer's right hand is inside second glove 104 or not, second glove 104 is fixed to second sleeve 114 and will not be lost.

As illustrated in FIGS. 19 and 20, first pocket 120 covers a majority of buckle 108 and second pocket 125 covers a majority of buckle 110. While first and second pockets 120 and 125 operate to hide buckles 108 and 110, the main purpose of first and second pockets 120 and 125 is so that first pocket 120 conceals first male buckle portion 128*a* so that first male buckle portion 128*a* is not unattractive to the wearer in the event the wearer does not have first glove 102 attached and second pocket 125 conceals second female buckle portion 142*b* so that second female buckle portion 142*b* is not unattractive to the wearer in the event the wearer does not have second glove 104 attached.

Figure 21:
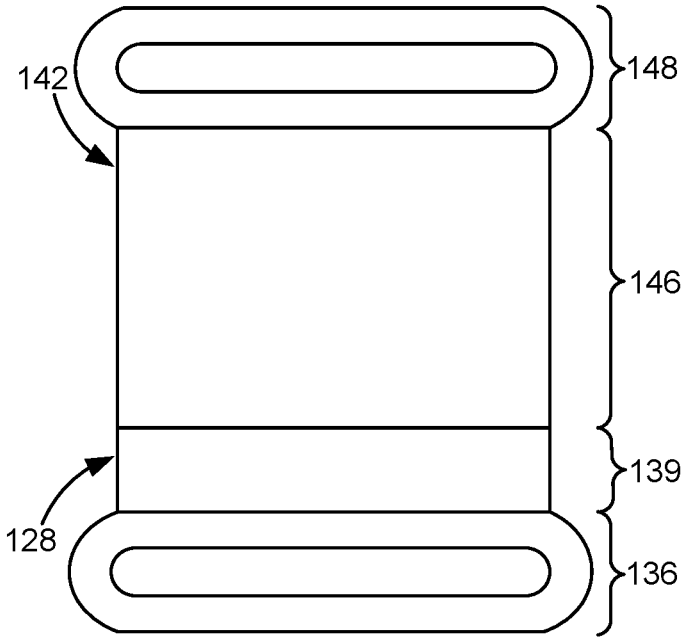
FIG. 21 is a front view of an embodiment of a buckle of the glove and garment system.
Figure 22:
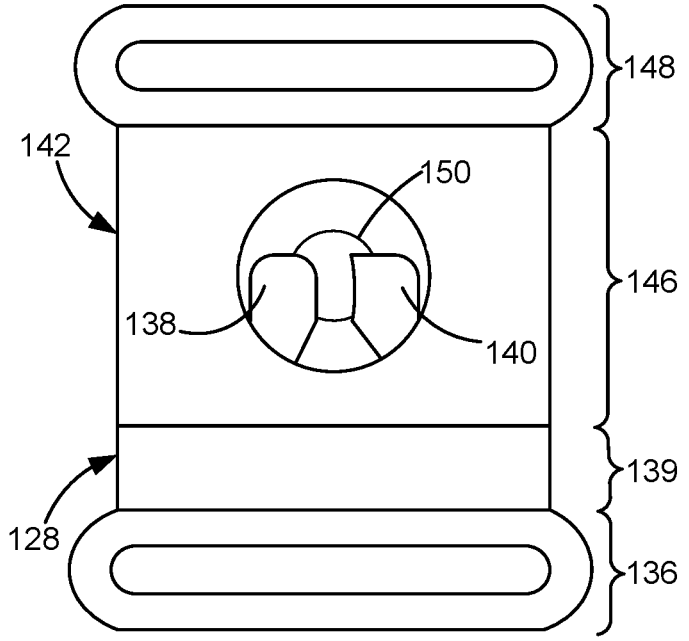
FIG. 22 is a back view of FIG. 21.

FIG. 21 is a top view of an exemplary buckle of the glove and garment system 100. FIG. 22 is a bottom view of FIG. 21. The exemplary buckle may be for use as buckle 108 that attaches first glove 102 to first sleeve 112, may be for use as buckle 110 that attaches second glove 104 to second sleeve 114 or may be for use as the buckle formed using the portions mounted to the each glove 102 and 104 as illustrated in n FIG. 5. The exemplary buckle includes female buckle portion 142 and male buckle portion 128, which are securely mated together by simply pushing fastening body 134 of male buckle portion 128 into fastening body 146 of female buckle portion 142 so that the interior facing surfaces of prongs 138 and 140 lock around center release button 150. To release male buckle portion 128 from female buckle portion 142, center release button 150 is pushed and prongs 138 and 140 unlock from center release button 150. As illustrated in FIGS. 21 and 22, the resulting exemplary buckle components that are visible after male and female buckle portions are secured together are attachment bar 148 and fastening body 146 of female buckle portion 142 and attachment bar 136 and central body 149 of male buckle portion 128.

With reference back to FIG. 5, when male buckle portion 128*a* is detached from female buckle portion 142*a* and male buckle portion 128*b* is detached from female buckle portion 142*b*, a new buckle 190 (FIG. 5) is capable of being formed and when formed puts glove and garment system 100 in the second or storage configuration. Buckle 190 includes female buckle portion 142*a* coupled to male buckle portion to fixedly attach first glove 102 to second glove 104.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

What is claimed is:

1. A glove and garment system comprising:

a garment adapted to be worn on a body of a wearer including a first sleeve having an exterior surface and configured to be worn on a first arm of the wearer and a second sleeve having an exterior surface and configured to be worn on a second arm of the wearer, wherein the first sleeve has a first male buckle portion mounted on the exterior surface of the first sleeve and a first pocket attached to the exterior surface of the first sleeve that covers at least a portion of the first male buckle portion, wherein the second sleeve has a second female buckle portion mounted on the exterior surface of the second sleeve and a second pocket attached to the exterior surface of the second sleeve that covers at least a portion of the second female buckle portion;

a first glove adapted to be worn on the wearer's first hand and having a first female buckle portion mounted thereon;

a second glove adapted to be worn on the wearer's second hand and having a second male buckle portion mounted thereon; and wherein in a first configuration of the glove and garment system the first male buckle portion is secured to the first female buckle portion to fix the first glove adjacent to a distal end of the first sleeve and the second male buckle portion is secured to the second female buckle portion to fix the second glove adjacent to a distal end of the second sleeve; and wherein in a second configuration of the glove and garment system the first female buckle portion is unbuckled from the first male buckle portion to separate the first glove from the distal end of the first sleeve, the second female buckle portion is unbuckled from the second male buckle portion to separate the second glove from the distal end of the second sleeve and the first female buckle portion is secured to the second male buckle portion to secure the first glove to the second glove.

2. The glove and garment system of claim 1, wherein each of the first and second male buckle portions and the first and second female buckle portions are portions of quick release buckles.

3. The glove and garment system of claim 1, wherein each of the first and second male buckle portions and the first and second female buckle portions comprise an attachment bar having an attachment bar proximal end and a fastening body with a fastening distal end that opposes the attachment bar proximal end.

4. The glove and garment system of claim 3, wherein the fastening distal end of the first female buckle portion is positioned at or extends proximally to a proximal edge of the wrist section of the first glove, and wherein the fastening distal end of the second male buckle portion is positioned at or extends proximally to a proximal edge of the wrist section of the second glove.

5. The glove and garment system of claim 4, wherein the fastening distal end of the first male buckle portion is positioned proximally relative to a distal end of a cuff of the first sleeve by a distance, and wherein the second female buckle portion is positioned proximally relative to a distal end of a cuff of the second sleeve by a distance.

6. The glove and garment system of claim 5, wherein the distance between the fastening distal end of the first male buckle portion and the distal end of the cuff of the first sleeve is less than 1 inch and wherein the distance between the fastening distal end of the second female buckle portion and the distal end of the cuff of the second sleeve is less than 1 inch.

7. The glove and garment system of claim 1, wherein the first female buckle portion is mounted to a dorsal side of the exterior surface of the first glove, wherein the second male buckle portion is mounted to a dorsal side of the exterior surface of the second glove, wherein the first male buckle portion is mounted to a dorsal side of the exterior surface of the first sleeve, and wherein the second female portion is mounted to a dorsal side of the exterior surface of the second sleeve.

8. The glove and garment system of 1, wherein first pocket comprises a four-sided first patch of material and the second pocket comprises a four-sided second patch of material, wherein three of the four sides of each of the first and second patches of materials are attached to the exterior surface of one of the first and the second sleeves and wherein one of the four sides of each of the first and second patches of materials are free from the exterior surface of one of the first and second sleeves.

9. The glove and garment system of claim 3, wherein each of the first and second pockets comprise an enclosed proximal end and an open distal end, wherein the open distal ends of the first and second pockets are positioned proximal to the fastening distal ends of the first male buckle portion mounted to the first sleeve and the second female buckle portion mounted to the second sleeve.

10. A glove and garment system comprising:

a garment adapted to be worn on a body of a wearer and including a first sleeve having an exterior surface, a dorsal side, a first pocket attached to the dorsal side of the first sleeve and adapted to be worn on a first arm of the wearer and a second sleeve having an exterior surface, a dorsal side, a second pocket attached to the dorsal side of the second sleeve and adapted to be worn on a second arm of the wearer;

a use configuration comprising:

a first female buckle portion mounted on a dorsal side of a first glove adapted to be worn on a first hand of the wearer and being secured to a first male buckle portion mounted to the exterior surface of the dorsal side of the first sleeve and is at least partially covered by the first pocket so that the first glove is fixed adjacent to a distal end of the first sleeve;

a second male buckle portion mounted on a dorsal side of a second glove adapted to be worn on a second hand of the wearer and being secured to a second female buckle portion mounted to the exterior surface of the dorsal side of the second sleeve and is at least partially covered by the second pocket so that the second glove is fixed adjacent to a distal end of the second sleeve;

a storage configuration comprising the first female buckle portion being separated from the first male buckle portion, the second male buckle portion being separated from the second female buckle portion and the first female buckle portion being buckled to the second male buckle portion to fix the first glove to the second glove.

11. The glove and garment system of claim 10, wherein each of the first and second male buckle portions and the first and second female buckle portions comprise an attachment bar having an attachment bar proximal end and a fastening body with a fastening distal end that opposes the attachment bar proximal end.

12. The glove and garment system of claim 11, wherein the fastening distal end of the first female buckle portion is positioned at or extends proximally to a proximal edge of the wrist section of the first glove, and wherein the fastening distal end of the second male buckle portion is positioned at or extends proximally to a proximal edge of the wrist section of the second glove.

13. The glove and garment system of claim 11, wherein the fastening distal end of the first male buckle portion is positioned proximally relative to a distal end of a cuff of the first sleeve by a distance, and wherein the second female buckle portion is positioned proximally relative to a distal end of a cuff of the second sleeve by a distance, wherein the distance between the fastening distal end of the first male buckle portion and the distal end of the cuff of the first sleeve is less than 1 inch and wherein the distance between the fastening distal end of the second female buckle portion and the distal end of the cuff of the second sleeve is less than 1 inch.

14. The glove and garment system of claim 11, wherein the first pocket comprises a first patch of material that is coupled to the exterior surface of the first sleeve and wherein the second pocket comprises a second patch of material that is coupled to the exterior surface of the second sleeve.

15. The glove and garment system of claim 10, wherein the first patch of material that forms the first pocket comprises four sides and wherein the second patch of material that forms the second pocket comprises four sides, wherein three of the four sides of each of the first and second patches of material are attached to the exterior surface of one of the first and the second sleeves and wherein one of the four sides of each of the first and second patches of materials are free from the exterior surface of one of the first and second sleeves.

16. The glove and garment system of claim 10, wherein each of the first and second pockets comprise an enclosed proximal end and an open distal end, wherein the open distal ends of the first and second pockets face the distal ends of the first and second sleeves.

17. A glove and garment system comprising:

a use configuration comprising:

a first female buckle portion mounted to an exterior surface of a first glove and buckled to a first male buckle portion mounted to an exterior surface of a first sleeve of a garment to fix the first glove adjacent to a distal edge of the first sleeve, wherein the first sleeve of the garment includes a first pocket comprised of a first patch of material that is coupled to the exterior surface of the first sleeve and conceals at least a portion of the first male buckle portion mounted to the exterior surface of the first sleeve;

a second male buckle portion mounted to an exterior surface of a second glove and buckled to a second female buckle portion mounted to an exterior surface of a second sleeve of the garment to fix the second glove adjacent to a distal edge of the second sleeve, wherein the second sleeve of the garment includes a second pocket comprised of a second patch of material that is coupled to the exterior surface of the second sleeve and conceals at least a portion of the second female buckle portion mounted to the exterior surface of the second sleeve;

a storage configuration comprising the first female buckle portion mounted to the first glove and being buckled to the second male buckle portion mounted to the second glove so that the first glove and the second glove are detached from the first and second sleeves of the garment and attached together.

18. The glove and garment system of claim 17, wherein each of the first and second male buckle portions and the first and second female buckle portions are portions of quick release buckles.

19. The glove and garment system of claim 17, wherein each of the first and second male buckle portions and the first and second female buckle portions comprise an attachment bar having an attachment bar proximal end and a fastening body with a fastening distal end that opposes the attachment bar proximal end, wherein the attachment bar of the first female buckle portion is mounted to a dorsal side of the exterior surface of the first glove, the attachment bar of the second male buckle portion is mounted to a dorsal side of the exterior surface of the second glove, the attachment bar of the first male buckle portion is mounted to a dorsal side of the exterior surface of the first sleeve, and the attachment bar of the second female portion is mounted to a dorsal side of exterior surface of the second sleeve.

20. The glove and garment system of claim 17, wherein each of the first and second pockets comprise an enclosed proximal end and an open distal end, wherein the open distal ends of the first and second pockets face the distal edges of the first and second sleeves.

* * * * *